United States Patent [19]

Freminet

[11] Patent Number: 4,760,786

[45] Date of Patent: Aug. 2, 1988

[54] APPARATUS FOR THE AUTOMATIC FEEDING OF SILK SCREEN PRINTING MACHINES WITH RUN-OUT PLATEN

[76] Inventor: Dany Freminet, Zone Commerciale Route de Saintes, F-17200 Royan, France

[21] Appl. No.: 53,616

[22] Filed: May 26, 1987

[30] Foreign Application Priority Data

May 23, 1987 [FR] France ..... 86 07510

[51] Int. Cl.[4] ..... B41F 21/12

[52] U.S. Cl. ..... 101/126; 101/129; 101/242; 271/236; 271/245

[58] Field of Search ..... 101/126, 124, 129, 123, 101/239, 241, 242; 271/245, 227, 228, 236, 237

[56] References Cited

U.S. PATENT DOCUMENTS

| | | | |
|---|---|---|---|
| 4,565,478 | 1/1986 | Ericsson . | |
| 4,588,183 | 5/1986 | Kitano | 271/236 |
| 4,699,370 | 10/1987 | Hashimoto et al. | 271/227 X |

FOREIGN PATENT DOCUMENTS

| | | | |
|---|---|---|---|
| 0021397 | 6/1979 | European Pat. Off. . | |
| 0097629 | 5/1982 | European Pat. Off. . | |
| 0097544 | 5/1982 | European Pat. Off. . | |
| 0179010 | 10/1984 | European Pat. Off. . | |
| 2571306 | 4/1986 | France | 101/126 |
| 11412 | 1/1980 | Japan | 271/236 |
| 593190 | 11/1977 | Switzerland . | |
| 2001037 | 7/1977 | United Kingdom . | |
| 2047624 | 4/1979 | United Kingdom . | |
| 2034025 | 5/1980 | United Kingdom | 271/227 |
| 2127384 | 9/1982 | United Kingdom . | |

OTHER PUBLICATIONS

Search Report of FR 86 07 510.
Search Report of EP 87 45 0014.
Search Report EP 85 45 0021.

*Primary Examiner*—Clifford D. Crowder
*Attorney, Agent, or Firm*—Robert J. Koch

[57] ABSTRACT

An improved device for the automatic feeding of silk screen printing machines with extension platens. The apparatus comprises:

a storage magazine for the sheets to be printed, piled flat in a pile;

structure associated with the printing platen and comprising a positioning support in an extension of the plane of this platen;

apparatus to seize and transfer individual sheets from the pile onto the positioning support;

frontal and lateral positioning structure for the sheet placed onto the positioning support; and positioned sheet transfer apparatus to seize and transfer the sheet from the positioning support to the printing platen.

19 Claims, 3 Drawing Sheets

APPARATUS FOR THE AUTOMATIC FEEDING OF SILK SCREEN PRINTING MACHINES WITH RUN-OUT PLATEN

BACKGROUND OF THE INVENTION

The present invention concerns automatic feeding devices for silk screen printing machines of the type comprising a horizontally displacing platen.

On these machines, the positioning of the material to be printed is carried out generally manually with the printing platen in the extended position awaiting the feed.

The operator must await the return of the printing platen into its extended position to place the material to be printed into its position of registration. If the material consists of a very thin sheet of paper or is of a large format, the operation is difficult, relatively lengthy and consequently reduces the maximum possible printing rate of the machine.

In order to remedy these disadvantages, the present applicant has conceived of a device for precise automatic feeding or positioning making it possible to increase the printing rate of the aforementioned machines. A related device was described in French Application No. 84 15352 (EP No. 179,010).

Briefly described, the device comprises the following:

a positioning platen located in the plane and laterally from the printing platen, integral with the latter, and comprising a mat or endless belt to bring the material to be printed into frontal abutment against margin stops and a device to bring said material into abutment against a lateral margin stop;

a feeder device for the material to be imprinted equipped at its upper part with guide rails in an extension of those of the printing platen;

a lifting device to seize the material to be printed in the feeder device and to deposit it in the positioning platen when located on the guide rails of the feeder device, and a lifting device located above the printing platen in the extended position and capable of transferring the material to be printed from the positioning platen onto the printing platen.

SUMMARY OF THE INVENTION

The objects of the present invention are to improve the abovedescribed apparatus relative to the feeding and positioning of the material on the printing platen of the machine, to improve the precision of positioning, and to lighten and reduce the size of the automatic feeder apparatus.

For these purposes, the invention comprises an automatic feeder apparatus for silk screen printing machines with extension printing platens which apparatus comprises:

a storage magazine for flatly stacking the sheets to be printed;

a printing platen extending in a plane;

a positioning support in the plane of said printing platen;

a feeding means for seizing and transferring sheets one-by-one from the pile to said positioning support;

a positioning means for frontal and lateral positioning of sheets placed onto the positioning support; and a positioned sheet transfer means for transferring correctly positioned sheets from the positioning surface onto the printing platen, wherein said positioning means comprises:

a transverse bar supported by the frame of the machine;

stops or the like for positioning the frontal edge of the sheet placed onto said positioning support;

frontal detection means to detect the presence of said front edge abutting against said stops;

sheets manipulation means to seize and lift said front edge and in response to control by said frontal detection means;

bar displacement means for displacing said transverse bar perpendicularly to the direction of the displacement of the printing platen in response to control by said frontal detection means and a lateral detection means;

said lateral detection means being located on the machine frame and being capable of (1) detecting the lateral edge of a sheet both on the positioning surface and after seizure by said sheet manipulation means (2) stopping bar movement, and (3) maintaining said bar in position; and extension control means for actuating extension of the printing platen so that said sheet may be deposited on it.

Advantageously, to reduce the size of the apparatus and to lighten it, said positioning surface comprises a platen bar integral with the printing platen and uncoiling support strips attached to said platen bar. The strips are located between the platen bar and the pile of sheets to be printed.

According to a further notable characteristic of the invention and in order to insure an absolutely rigorous placement of each sheet on the printing platen, the bar-displacement means is mounted to slide parallel to the direction of displacement of the printing platen. The bar is returned to its at-rest position by a spring or the like. The motion has a small amplitude and occurs when stops (or the like) integral with the printing platen contact terminal supports on the bar displacement means. Because of such affirmative positioning, the feed sheet is reliably transferred in proper registration to the printing platen.

BRIEF DESCRIPTION OF THE DRAWINGS

Further characteristics and advantages will be apparent from the description below of an embodiment of the invention. This description is given as an example only and with reference to the drawings attached hereto. In the drawings.

DETAILED DESCRIPTION OF THE DRAWINGS

Figure 1:
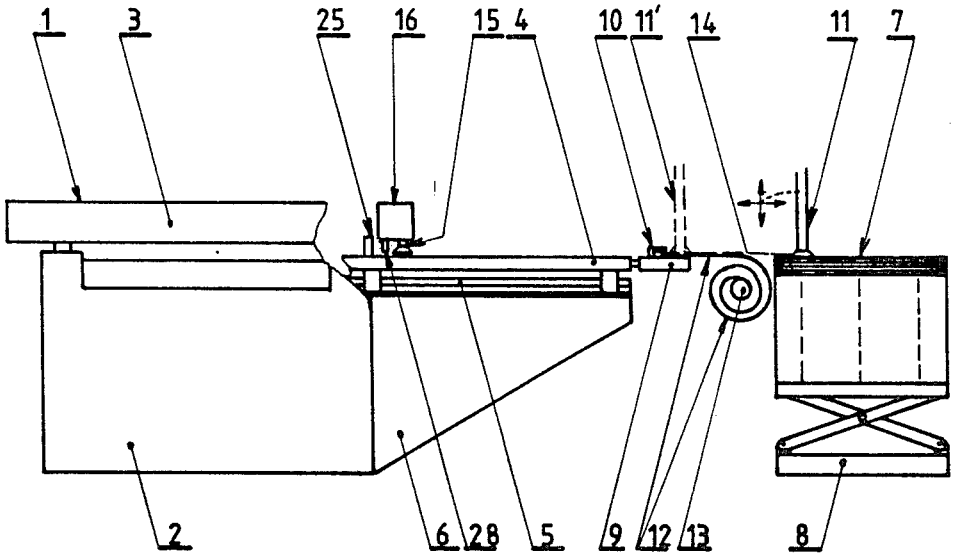
FIG. 1 is a general schematic side view of an apparatus according to the invention.
Figure 2:
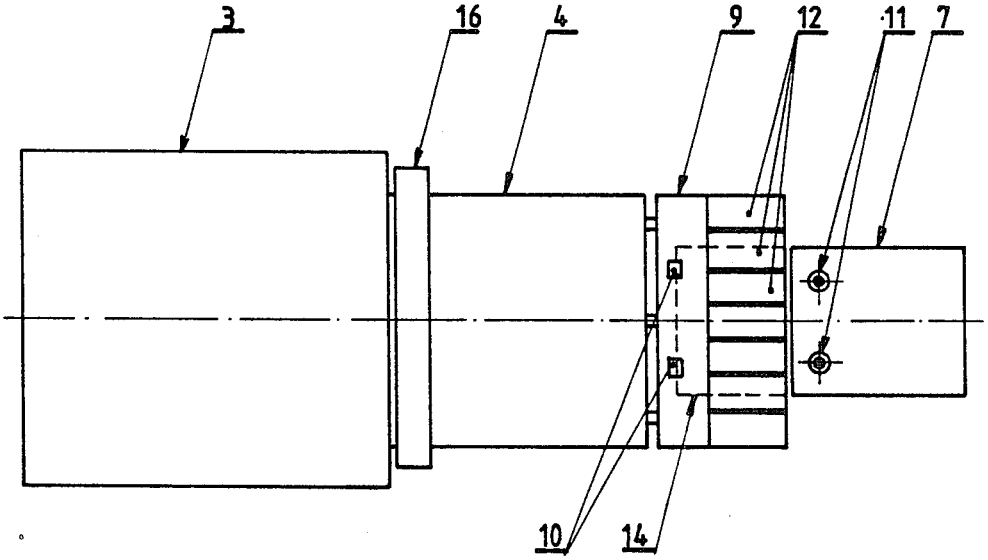
FIG. 2 is a top view of the apparatus of FIG. 1.

In FIG. 1, a silk screen printing machine 1 of the extension platen type is shown schematically. Such a machine type is known and does not need to be described in detail.

Briefly, such a machine type comprises a stand 2 supporting a pattern holder frame 3 and a printing plate 4 (shown in the extended position). Platen 4 moves on horizontal rails 5 which are located on frame 3 and extend over the side of the machine. Rails 5 are supported by bracket 6 which is carried by stand 2.

According to the improved apparatus of the invention, printing platen 4 extends its frontal edge toward the pile 7 of feed sheets 14 to be imprinted. Sheets 14 are placed flat on elevating X-table 8. The extension of platen 4 is a positioning surface of small dimensions comprising a single flat bar 9 with a length equal to the width of the platen 4. The width of bar 9 is sufficient for the mounting of two retractable grippers 10 to seize sheets 14 from pile 7 fed by a seizing system of, for example, suction cups 11 and suction system.

The elevating table 8 is of a well known type. Table 8 raises under the control of photoelectric cells so as to maintain the top sheet of pile 7 essentially at the same height regardless of the height of pile 7.

The platen bar 9 connects a set of uncoiling strips 12. The connection is opposite the connection with platen 4. Strips 12 are wound around a rotating drum 13. Drum 13 has a stationary horizontal axle.

Strips 12 are placed adjacent over the width of bar 9 and are intended to support each sheet 14. Sheets 14 are seized from pile 7 by suction system 11 and moved over platen bar 9 in a manner such that the front edge of each sheet 14 is seized by the grippers 10.

In FIG. 1, strips 12 are shown almost completely wound on drum 13. However, when platen 4 retracts under frame 3, strips 12 are almost completely uncoiled and form (with their top faces) an extension of the top surface of platen bar 9. The surface formed is a horizontal plane supporting sheet 14 as it is moved toward machine 1.

The method of making a system of uncoiling strip supports 12 is well known. As a brief description, the strip supports 12 comprise bands to retract the support strips into their wound position and retracting rollers as well as the strips and drum described above. The unwinding movement of strips 12 is effected by the movement platen bar 9 which is in turn, connected with platen 4.

Drum 13 is at approximately the height of pile 7 to ensure the continuity of the horizontal plane in which sheet 14 moves from the top of pile 7 to printing platen 4.

The suction system 11 which seizes and transfers sheets 14 is of a conventional construction. The system contemplated comprises, two vertical suction cups located at rest above pile 7 at some distance from the pile edge facing machine 1. The two suction cups are mounted on the mobile frame (not shown) which moves vertically and horizontally so as to seize the top sheet from pile 7 near the sheet edge facing machine 1. Sheet 14 is lifted and transferred to grippers 10 (in the position shown in FIG. 1) where it is retained.

The extreme movement position of the suction cups is shown by broken lines after their translation toward the platen 4.

The means controlling the displacement of the suction cups is entirely conventional and need not to be described in detail.

Once suction cups are in position 11', the vacuum is released, the suction cups release sheet 14 (which is held by gripper 10) and return to their initial rest position above the pile 7. Suction system 11 is ready for a new cycle of sheet seizure and transport.

According to an advantageous characteristic of the invention, sheet 14 is deposited onto platen bar 9 slightly farther than necessary relative to the optimal position of sheet 14 relative to support assembly 9–12. The optimal position is that corresponding to the exact placement of sheet 14 on printing platen 4.

The precise placement of sheet 14 on support assembly 9–12 is effected at the end of the loading stroke of printing platen 4. This placement is by means of the positioning device 16.

Figure 3:
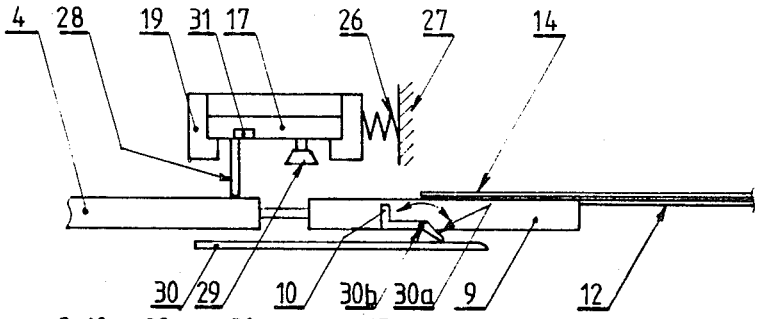
FIG. 3 is a more detailed side view of the frontal and lateral sheet positioning means on the positioning means.
Figure 4:
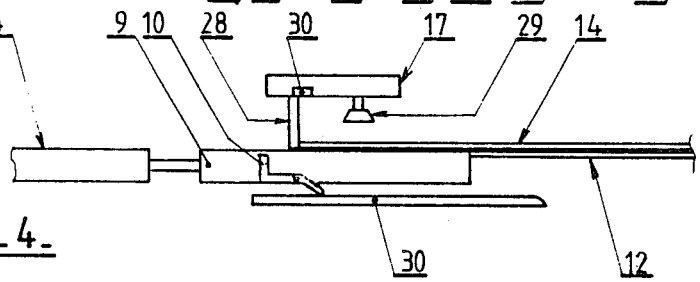
FIG. 4 shows the apparatus of FIG. 3 at the final end of the positioning stroke of the printing platen.
Figure 5:
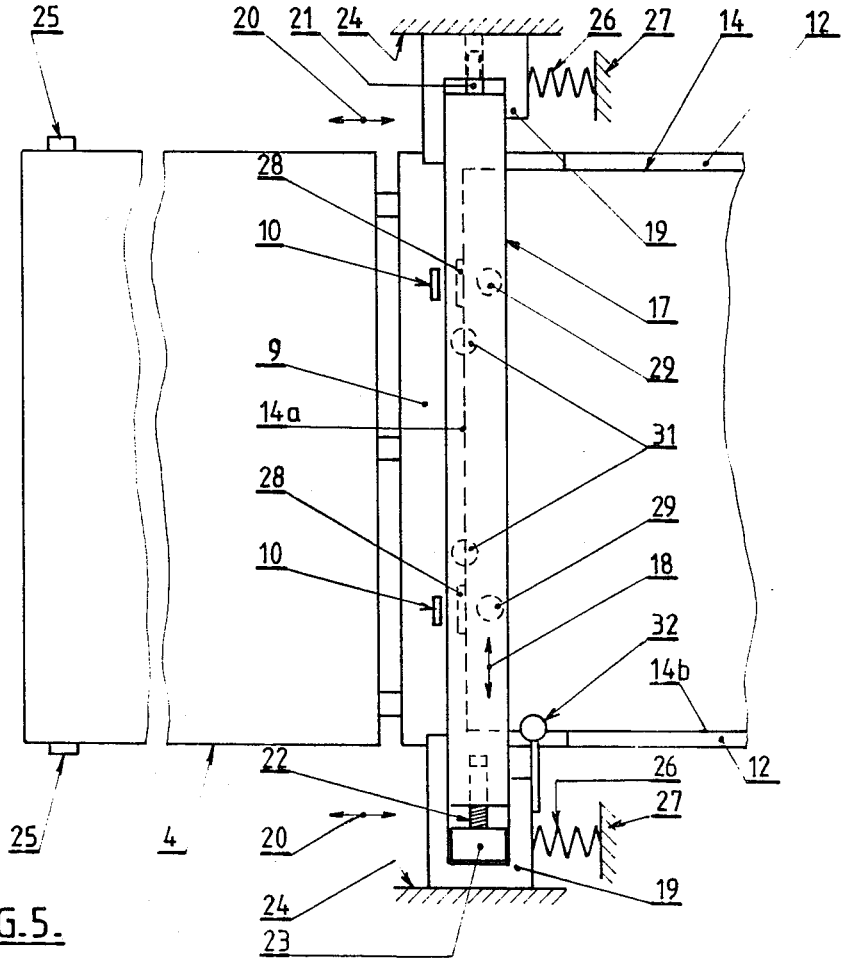
FIG. 5 is a top view of the apparatus of FIG. 4.
Figure 6:
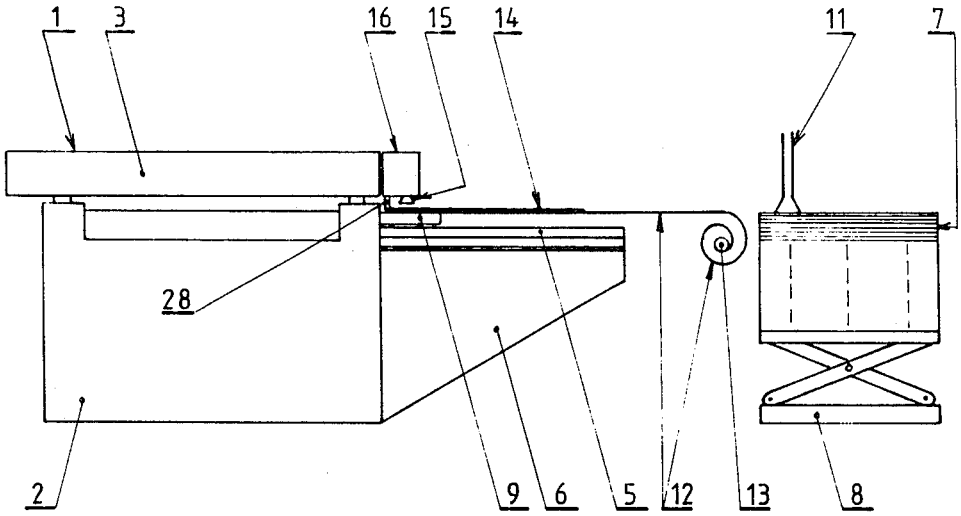
FIG. 6 shows the apparatus of FIG. 1 with the printing platen in the final end of the positioning stroke as in FIG. 4.

Positioning device 16 is shown in more detail in FIGS. 3 to 5. Device 16 comprises a horizontal transverse bar 17 mounted in a laterally mobile manner according to double arrow 18 in two terminal guide pieces 19. Terminal guide pieces 19 are mounted to move front-to-back as indicated by double arrows 20. For lateral movement, bar 17 comprises a guide axle 21 sliding in a hole in guide piece 19 at one end and a threaded hole engaged by a screw from an electric motor 23 which is integral with the other guide piece 19. During rotation of screw 22, bar 17 is prevented from rotating by guide pieces 19 and moves in a lateral direction 18. This movement is perpendicular to the front-to-back displacement 20 of printing platen 4. As bar 17 moves in direction 20, guide pieces 19 are guided by appropriate elements 24 which are integral with stand 2 of machine 1.

The front-to-back displacement of guide pieces 19 is effected by two stops 25 fastened to printing platen 4. Stops 25 are fastened so as to contact internal flanks of pieces 19 when platen 4 is fully extended from machine 1 (strips 12 are almost completely coiled around drum 13). At full extension, stops 25 contact pieces 19 causing a slight displacement of pieces 19 and bar 17 in direction 20.

Guide pieces 19 and bar 17 return automatically into their initial positions by appropriate means, such as springs 26, placed between pieces 19 and part 27 of stand 2.

In FIGS. 3–5, two frontal positioning stops 28 are located under bar 17 for the frontal positioning of sheet 14 on the assembly 9–12.

Two vertical suction cups 29 are located under bar 17 toward pile 7 and facing downward. The vacuum supply for the suction cups is not shown for the sake of clarity.

Frontal stops 28 and suction cups 29 are placed in a manner such that printing platen 4 and platen bar 9 are able to circulate freely under transverse bar 17.

Facing bar 17 and above the path of the assembly 4–9, means such as stationary cam 30 cooperate with a thrustor **30*a*. This thrustor is integral with grippers 10. Grippers 10 release sheet 14 by rotation around axle 30*b* when thrustor 30*a* contacts stationary cam 30 as platen bar 9 moves toward machine 1. Sheet 14 is released and contacts (FIG. 4) frontal positioning stops 28. This contact causes the sheet to retreat for a very short distance (of the order of 1 to 3 mm, for example) on the assembly 9–12. As described above, depositing sheet 14** slightly farther than necessary for optimal positioning compensates for this movement thereby assuring precise frontal positioning.

Photoelectric reflection cells 31 are mounted under the bar 17. They detect the frontal edge **14*a* of sheet 14 when edge 14*a* abuts against stops 28. The detection of edge 14a by the cells actuates suction cups 29 which lift and hold the edge of sheet 14. Motor 23 then starts and draws bar 17 towards it until the lateral edge 14b of sheet 14 (FIG. 5) is detected by a photoelectric reflection cell 32 integral with guide piece 19**.

The signal emitted by cell 32 stops motor 23 and maintains sheet 14 in perfect frontal and lateral registration.

It only remains now to transfer sheet 14 to printing platen 4. For this purpose platen 4 extends out from machine 1 and under positioned sheet 14. During the extension, grippers 10 leave cams 30 and return to their active position ready to grip the edge of a new sheet supplied by system 11.

Figure 7:
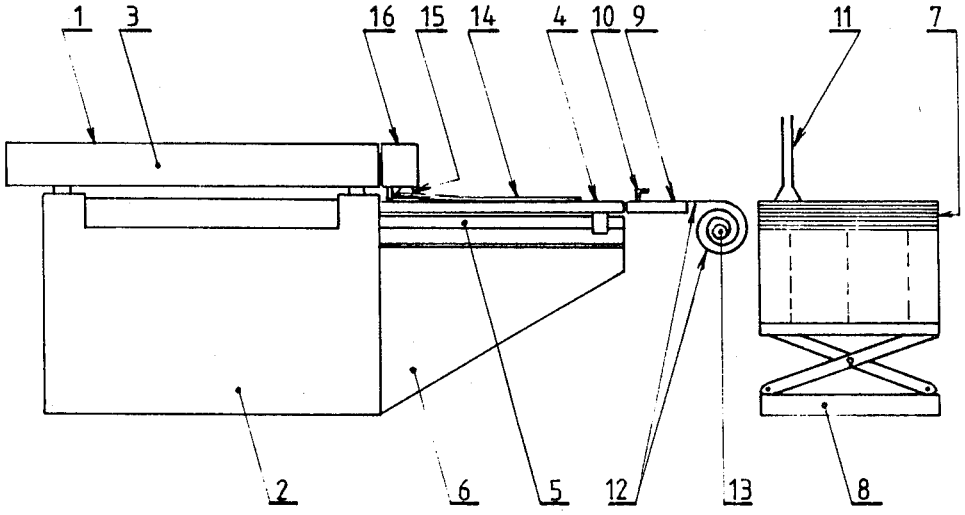
FIG. 7 shows the apparatus of FIG. 6 at the extended position of the printing platen.

At the end of the extension of platen 4, stops 25 simultaneously contact guide pieces 19 and urge them against springs 26 for a very short distance (for example, one-tenth of a mm). This contacting is sufficient to ensure a remarkably precise positioning of sheet 14 over platen 4. Sheet 14 is then released by suction cups 29 (FIG. 7).

Platen 4 and its sheet 14 are now able to return under frame 3 for printing. While platen 4 returns into the printing machine, a new sheet is simultaneously moved into position under grippers 10.

The sheet transfer cycle is thus repeated automatically at the printing rate of the machine, i.e. without any loss of time and without human intervention.

When sheet 14 is released by suction cups 29 onto platen 4, bar 17 is preferably returned into its initial transverse position. This return to center is advantageous so that sheet 14 always is displaced toward cell 32.

It should be understood that this cell 32 is transversely adjustable to assembly 9–12. Grippers 10, suction cups 11, frontal supports 28, and photoelectric cells 31 are adjustable with respect to their spacings by appropriate mounting on their respective supports.

The device of the invention is thus capable of handling not only sheets of different formats, but also of different weights without problems and without requiring intermediate adjustments.

It should further be understood that the apparatus is equipped with the usual means to assure the control and sequencing of the different phases of the operating cycle.

Finally, the invention is obviously not limited to the mode of embodiment described above but covers all variants obvious to one in this art. In particular, other means of seizing and transferring the individual sheets to be printed may replace the suciton cup means described. Suction cups 29 may be replaced by a known system of closable suction slits to adapt to different formats. Similarly, retractable grippers 10, photoelectric detector cells 31 and 32, or transverse displacement means for bar 17 may also be replaced by other means providing the same effects.

Furthermore, the major function of the uncoiling strips 12 is to lighten the sheet transfer device between the pile 7 and printing machine 1. The assembly 9–12 may be replaced by a rigid platen of the positioning platen type described in the initially aforecited patent application.

What is claimed is:

1. Automatic feeder apparatus for a silk screen printing machine with an extension printing platen comprising:

a storage magazine for sheets to be printed;

a printing platen moving in a plane;

a positioning support in the plane of said printing platen;

feeding means for seizing and transferring a sheet from said storage magazine onto said positioning support;

positioning means for frontally and laterally positioning said sheet on said positioning support; and positioned sheet transfer means for transferring a positioned sheet from said positioned support onto said printing platen, wherein said positioning means comprises:

a transverse bar supported by said apparatus;

frontal stops for positioning a frontal edge of said sheet on said positioning support;

frontal detection means for detecting said frontal edge when abutting said frontal stops;

sheet manipulation means to seize and lift said frontal edge in response to control by said frontal detection means;

bar displacement means for displacing said transverse bar perpendicularly to printing platen motion in response to control by said frontal detection means and a lateral detections means;

said lateral detection means being located on said apparatus and for (1) detecting a lateral edge of said sheet both on said positioning surface and after seizure by said sheet manipulation means, (2) stopping bar movement, and (3) maintaining said bar in position; and extension control means for actuating extension of said printing platen.

2. Apparatus according to claim 1, wherein said positioning support comprises a platen bar attached to said printing platen and to coiled support strips located between said platen bar and said storage magazine.

3. Apparatus according to claim 2, wherein said platen bar comprises gripping means for seizing a front edge of sheets transferred from said storage magazine.

4. Apparatus according to claim 3, wherein said gripping means comprises grippers which retract during passage under said transverse bar.

5. Apparatus according to claim 1, wherein said feeding means comprises suction cups.

6. Apparatus according to claim 1, wherein said positioning means comprises suction cups.

7. Apparatus according to claim 1, comprising mounting means for mounting said positioning means slidingly relative to said apparatus and for movement parallel to printing platen movement.

8. Apparatus according to claim 7, further comprising return means for returning said positioning means to an initial position before movement parallel to said printing platen movement.

9. Apparatus according to claim 7, wherein said positioning means further comprises stops connected to said printing platen and which contact said mounting means when said printing platen extends from said silk screen printing machine.

10. Apparatus according to claim 1, wherein said frontal detection means comprises a photoelectric reflection cell.

11. Apparatus according to claim 1, wherein said lateral detection cell comprises a photoelectric reflection cell.

12. Apparatus according to claim 1, wherein said sheet manipulation means comprises suction cups.

13. Apparatus according to claim 1, wherein said sheet manipulation means comprises suction slits.

14. Apparatus according to claim 1, wherein said positioned sheet transfer means is adjustable perpendicularly to printing platen movement.

15. Apparatus according to claim 1, wherein said positioning means is adjustable perpendicularly to printing platen movement.

16. A process for automatically silk screen printing comprising:

lifting a sheet of printing material from a stack of sheets of printing material;

transferring said sheet forward to a gripping means which grips and secures said sheet, said gripping means being attached to a positioning platen;

securing said sheet to said platen by said gripping means;

displacing said sheet in said gripping means and said positioning platen to a positioning means for positioning said sheet relative to said positioning platen;

positioning said sheet relative to said positioning platen by:

(1) detecting a front edge of said sheet as it is displaced toward said positioning means, (2) stopping displacement toward said positioning means in response to control by a means for detecting said front edge of said sheet, (3) lifting and holding said front edge of said sheet when displacement toward said positioning means stops, (4) displacing said sheet laterally, and (5) stopping lateral displacement of said sheet in response to control from a means for detecting a lateral edge of said sheet;

transferring said sheet to a printing platen by:

(a) displacing said positioning platen and a printing platen toward said stack of printing material and under said sheet, (b) stopping movement of said printing platen at a predetermined position, and (c) releasing said sheet to said printing platen when said printing platen stops at said predetermined position;

displacing said printing platen and said sheet to a silk screen printing machine; and printing on said sheet.

17. A process according to claim 16 wherein said lifting of a sheet of printing material from a stack of sheets of printing material is accomplished by suction applied to said sheet of material.

18. A process according to claim 16, wherein said gripping means secures said sheet to said positioning platen in a position slightly farther than its optimal position relative to said platen.

19. A process according to claim 17, wherein said sheet is supported by support strips uncoiling from around a rotating drum as said positioning platen is displaced toward said positioning means.

* * * * *